US005186456A

United States Patent [19]

Takeno

[11] Patent Number: 5,186,456

[45] Date of Patent: Feb. 16, 1993

[54] GOLF TEE AND ITS MANUFACTURING METHOD

[75] Inventor: Katsuji Takeno, 15-47, Nagayoshi Deto 6-chome, Hirano-ku, Osaka, Japan

[73] Assignee: Katsuji Takeno, Osaka, Japan

[21] Appl. No.: 745,883

[22] Filed: Aug. 16, 1991

Related U.S. Application Data

[60] Division of Ser. No. 563,943, Aug. 7, 1990, Pat. No. 5,085,432, which is a continuation of Ser. No. 200,556, May 31, 1988, abandoned.

[30] Foreign Application Priority Data

May 31, 1987 [JP] Japan ..... 62-085310
May 31, 1987 [JP] Japan ..... 62-085311
Sep. 19, 1987 [JP] Japan ..... 62-235692

[51] Int. Cl.[5] ..... A63B 57/00
[52] U.S. Cl. ..... 273/33
[58] Field of Search ..... 273/33, 202–212

[56] References Cited

U.S. PATENT DOCUMENTS 1,554,721 9/1925 Getchell ..... 273/33
1,588,815 6/1926 Sillcocks ..... 273/33
1,604,390 10/1926 Coker ..... 273/33
1,627,012 5/1927 Copeland ..... 273/209
1,635,376 7/1927 McIlvaine ..... 273/210
1,647,440 11/1927 Fish ..... 273/33
1,661,513 8/1928 Sweet .
1,759,657 6/1930 McLeod .
1,815,520 7/1931 McLeod ..... 273/33
1,850,560 3/1932 Middlendorf ..... 273/33
3,645,537 4/1972 Parentear .
3,747,927 7/1973 Hoffman ..... 273/33
3,884,479 5/1975 Gordos ..... 273/212
3,954,263 5/1976 Whelan et al. ..... 273/33
4,014,541 3/1977 Desmarais ..... 273/212
4,126,438 11/1978 Pulli ..... 273/212
4,893,818 1/1990 Liccardello ..... 273/212
5,085,432 2/1992 Takeno ..... 273/33
5,085,438 2/1992 Takeno ..... 273/212

FOREIGN PATENT DOCUMENTS 4752 of 1905 United Kingdom ..... 273/33
190635 12/1922 United Kingdom ..... 273/33
525115 8/1940 United Kingdom ..... 273/121
592318 9/1947 United Kingdom ..... 273/33

*Primary Examiner*—Theatrice Brown
*Attorney, Agent, or Firm*—Birch, Stewart, Kolasch & Birch

[57] ABSTRACT

A golf tee formed of a water-soluble substance, and manufactured by a method comprising preparing a water-soluble substance, molding the water-soluble substance and drying and hardening the molded object by heating. The golf tee, molded of the water-soluble substance, weathers when it is left on the ground.

5 Claims, 1 Drawing Sheet

GOLF TEE AND ITS MANUFACTURING METHOD

This application is a divisional of copending application Ser. No. 07/563,943, filed on Aug. 7, 1990 (U.S. Pat. No. 4,085,432), which is a continuation of application Ser. No. 07/200,556, filed on May 31, 1988, now abandoned, the entire contents of which are hereby incorporated by reference.

BACKGROUND OF THE INVENTION

1. Field of the Invention

The present invention relates to a golf tee and its method of manufacture.

2. Description of the Prior Art

Golf tees heretofore used are formed by cutting and shaving wood members or by molding utilizing a synthetic resin or the like.

With golf tees formed by cutting and shaving, however, cutting wastes and shavings resulting from the manufacturing process translates to a loss of resources. Even worse, the manufacture of golf tees by this method, which involves the cutting and shaving of wood, is troublesome.

The use of golf tees made by molding a synthetic resin or the like causes a spoiling of the environment because many of the tees are broken and scattered in the tee area, and since they neither weather nor decay they become a disposal problem.

BRIEF SUMMARY OF THE INVENTION a primary object of the present invention is to provide a golf tee which can be easily manufactured without waste and which does not spoil the environment of a golf course.

Another object of the present invention is to provide a manufacturing method for a novel golf tee.

A first invention relates to a golf tee formed of a material which is soluble in water.

A further embodiment of the present invention relates to a method of manufacturing a golf tce comprising a process of preparing a water-soluble material, molding a tee made of the aforementioned water-soluble substance and drying and hardening the molded tee by heating.

The golf tee, molded of a water-soluble substance, weathers when it is left in the ground.

According to the present invention, a golf tee can be manufactured with ease by molding it of a water-soluble substance and then drying and hardening it. By following the present process no waste of resources as cutting wastes or shavings will result.

Also, when such a golf tee is scattered in or around a tee area, it will be assimilate with the earth by dissolving in rain water or by weathering.

The above-mentioned objects, features and advantages of the present invention will become more apparent from the detailed description of the embodiments discussed below with reference to the annexed drawings.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENT

Figure 1:
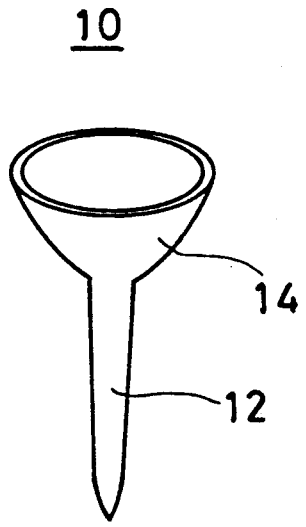
FIG. 1 is a perspective view showing one embodiment of the present invention.

FIG. 1 is a perspective view showing one embodiment of the present invention.

The golf tee 10 has a shaft portion 12 whose one end is pointed. At the other end of this shaft portion is formed a dish-like ball holder 14.

When the golf tee 10 is used, the shaft position 10 is stuck into the earth of the tee area and a golf ball is placed on the ball holder 14.

The golf tee 10 may be formed of an efflorescent material such as clay. In this case, the clay is molded by the use of, for example, a gypsum mold and then dried and hardened in a dryer for approximately 3 hours at 50°-65° C. to make a golf tee 10. When the gypsum mold is used, the molded tee can be released from the mold easily without using a releasing agent.

By this method the golf tee 10 can be molded of clay, and hence it can be manufactured easily without causing material waste. Moreover, if the golf tee 10 is left on the tee ground, it weathers with the lapse of time and readily assimilates into the earth. Thus there is no fear of it spoiling the environment of the golf course.

Also, since the golf tee 10 is made of clay and then dried and hardened, it is mechanically weaker than its counterparts made of wood or synthetic resin, and thus is broken with relative ease when it is hit by a golf club. There is, therefore, less of a problem of the shot impact to the ball being reduced due to the golf tee 10.

Although clay is used as the material of the golf tee 10 in the aforementioned embodiment, other clay-like substances may be used as well. Typical of a material for a golf tee 10 which may be used, includes a kneaded mixture consisting of 90 weight % of pulverized granite, calcium carbonate or the like, 8 weight % of pulp, 1.5 weight % of artificial paste such as a chemical starch and 0.5 weight % of a preservative and a mildew-proof agent. The kneaded mixture is molded, dried and hardened by heating for approximately 3 hours at 50°-65° C. to make the golf tee 10. The golf tee 10 made of such a material has its mechanical strength modifiable through adjustment of the water content of the pulp used. Also decay of the golf tee 10 before use can be prevented by a preservative and a meldew-proof agent which is added thereto. If necessary, its surface may be colored by coating with a proper paint. The golf tee 10, made of such a material, can be manufactured with ease and without waste and with it there is no fear of spoiling the environment of the golf course.

In the aforementioned embodiments the mold used is made of gypsum, but as mold material a synthetic resin or metal may be used as well. When the synthetic resin mold is used, the number of clay tees moldable per mold is larger than with the aforementioned gypsum mold. The synthetic resin mold, however, requires an inside coating with a non-silicone releasing agent such as a stearic acid to facilitate releasing of the molded object, i.e. the golf tee 10.

When a metal mold is used, a Teflon (Trademark) coating is required to prevent rusting of the mold due to moisture.

Figure 2:
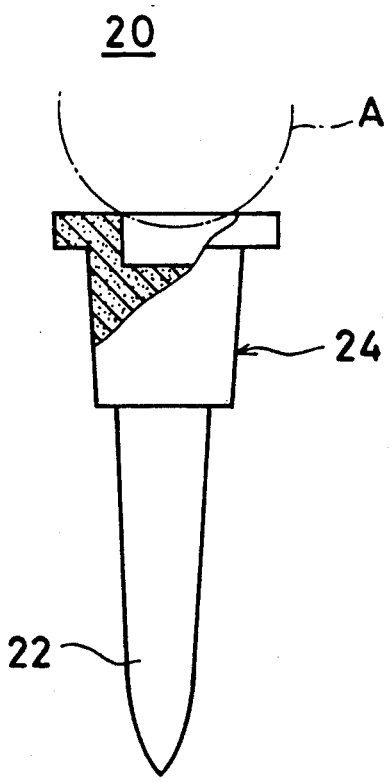
FIG. 2 is a partially cutaway front view showing another embodiment of the present invention.

FIG. 2 is a partially cutaway front view showing another embodiment of the present invention.

This golf tee 20 has a dish-like ball-holder 24 formed at the top of a shaft portion 22 with its lower end pointed, and is made of a fibrous material.

The above-mentioned golf tee is good when the club used is a "wood" or an "iron", and the fibrous material may be thus formed in any desired shape and the second tee then dried and hardened.

The golf the 20 is formed by solidifying a pasty fibrous material such as dissolved paper pulp which is then dried and hardened. The aggregation of fibers imparts thereto a mechanical strength sufficient to enable the tee to a stud into the ground without breaking the tee, and the dried and hardened tee can be colored in any desired shade, if desired.

The golf tee 20 of the present invention is of the above-mentioned construction and, when its shaft portion 22 is stuck into the ground and a "tee shot" is made with a golf ball A being placed on the ball holder, 24 and the golf tee 20 is broken impact of the shot, the broken tee left on the ground will be dissolved by water such as rain gradually assimilate into the earth and disappear with the passage of time, thereby not contaminating the environment.

Moreover, because the golf tee of the present invention is easily broken by the impact of the shot, it does not produce undue resistance to the club.

Having described the invention as it relates to the embodiment shown in the accompanying drawing, it is the that the present invention not be limited by any of the details of the description, but rather should be construed broadly within the spirit and scope as set out in the accompanying claims.

What is claimed is:

1. A water-soluble golf tee made of a composition consisting essentially of:

90% by weight of pulverized granite;

8% by weight of fibrous pulp;

1.5% by weight of starch; and 0.5% by weight of a preservative and an anti-mildew agent.

2. The water-soluble golf tee according to claim 1, wherein said fibrous pulp is paper pulp.

3. A golf tee made of a composition consisting essentially of a water-soluble fibrous material, said fibrous material being comprised a kneaded mixture consisting of 90% by weight of pulverized granite, 8% by weight of pulp, 1.5% by weight of chemical starch, and 0.5% by weight of a preservative and mildew proof agent, said composition further includes a strength enhancing sizing material, whereby said tee has sufficient strength to penetrate the earth's surface while at the same time being assimilatable into the earth with the passage of time.

4. The golf tee according to claim 3, wherein said water-soluble fibrous material is dissolved paper pulp.

5. The golf tee according to claim 3, wherein the sizing material is starch.

* * * * *